US009402468B1

(12) United States Patent
Chen

(10) Patent No.: US 9,402,468 B1
(45) Date of Patent: Aug. 2, 2016

(54) FOLDABLE SUPPORT DEVICE

(71) Applicant: Te-Lung Chen, Tainan (TW)
(72) Inventor: Te-Lung Chen, Tainan (TW)

( * ) Notice: Subject to any disclaimer, the term of this patent is extended or adjusted under 35 U.S.C. 154(b) by 0 days.

(21) Appl. No.: 14/613,436
(22) Filed: Feb. 4, 2015

(51) Int. Cl.
*A47B 3/00* (2006.01)
*A47B 3/12* (2006.01)

(52) U.S. Cl.
CPC .. *A47B 3/12* (2013.01); *A47B 3/002* (2013.01)

(58) Field of Classification Search
CPC ..... A47B 5/04; A47B 31/04; A47B 3/00; A47B 3/14; A47B 3/02; A47B 2003/0806; A47B 3/002; A47B 13/003; A47B 2001/005; Y10T 16/546; Y10T 16/547; Y10T 16/5474; Y10T 16/5475; Y10T 16/558; Y10T 16/5595; Y10T 16/55963; E05D 3/00; E05D 3/06; E05D 3/12; E05D 5/02; E05D 5/046; E05D 5/06; E05D 5/062; E05D 5/065; E05D 5/04
USPC ..... 108/168, 169, 172, 174, 115, 124, 67, 108/166, 167, 171, 176; 16/365, 366, 368, 16/369, 387, 389, 390; 248/166, 170, 248/188.6, 150
See application file for complete search history.

(56) References Cited

U.S. PATENT DOCUMENTS

| | | | | | |
|---|---|---|---|---|---|
| 581,915 | A * | 5/1897 | Lord | A47B 3/00 | 108/174 |
| 1,732,800 | A * | 10/1929 | Boutell | D06F 81/02 | 108/115 |
| 2,079,639 | A * | 5/1937 | Swensson | A47B 5/04 | 108/124 |
| 2,325,182 | A * | 7/1943 | Fitzpatrick | E05D 3/12 | 108/169 |
| 2,729,526 | A * | 1/1956 | Humphrey | A47B 1/04 | 108/79 |
| 2,791,477 | A * | 5/1957 | Wesbecher | A47B 3/0803 | 108/11 |
| 2,903,311 | A * | 9/1959 | Earhart | A47G 23/06 | 108/37 |
| 3,191,991 | A * | 6/1965 | Anderson | A47B 3/14 | 108/115 |
| 3,379,145 | A * | 4/1968 | Lieberman | A47B 3/00 | 108/166 |
| 3,613,152 | A * | 10/1971 | Spurlin | E05D 3/12 | 16/302 |
| D252,965 | S * | 9/1979 | Petersen | D6/692.4 | |
| 4,242,773 | A * | 1/1981 | Beigh | E05D 3/12 | 16/371 |
| 4,928,350 | A * | 5/1990 | Morgan | E05D 3/12 | 16/297 |
| 5,549,055 | A * | 8/1996 | Kusch | A47B 13/003 | 108/115 |
| 7,299,753 | B2 * | 11/2007 | Strong | A47B 3/083 | 108/115 |
| 8,789,477 | B2 * | 7/2014 | Jimenez Mangas | A47B 13/02 | 108/115 |
| 2006/0021550 | A1 * | 2/2006 | Sagol | A47B 3/02 | 108/115 |
| 2014/0150696 | A1 * | 6/2014 | Peng | A47B 3/002 | 108/34 |
| 2016/0008070 | A1 * | 1/2016 | Choudhury | A61B 19/0248 | 108/106 |

FOREIGN PATENT DOCUMENTS

| | | | |
|---|---|---|---|
| GB | 2059255 | * | 4/1981 |
| WO | 2007043084 | * | 4/2007 |

* cited by examiner

*Primary Examiner* — Janet M Wilkens
(74) *Attorney, Agent, or Firm* — Alan D. Kamrath; Kamrath IP Lawfirm, P.A.

(57) ABSTRACT

A support device includes a bearing unit, and a supporting frame. The bearing unit includes two bearing members. The supporting frame includes a supporting mechanism combined with the bearing unit, and a stand unit connected with the supporting mechanism and supporting a bottom of the bearing unit. When the support device is disposed at an expanded position, the bearing members are parallel and juxtaposed to each other, and the supporting mechanism bridges and supports the bottom of the bearing members. When the support device is switched to a collapsed position, the bearing members are arranged in an upright manner and are located at two opposite side of the supporting frame. Thus, the support device has a largely reduced volume and has an enhanced strength to withstand a larger force or weight.

3 Claims, 12 Drawing Sheets

FOLDABLE SUPPORT DEVICE

BACKGROUND OF THE INVENTION

1. Field of the Invention

The present invention relates to a support device and, more particularly, to a foldable support device that can be collapsed and expanded.

2. Description of the Related Art

A conventional support device 1 in accordance with the prior art shown in FIGS. 1 and 2 comprises a stand unit 11, a pivoting mechanism 12, and a table plate 13 mounted on the top of the pivoting mechanism 12. The stand unit 11 includes two stands 110 that are pivoted about a rotation center to expand and fold the stand unit 11. Each of the stands 110 includes two upright posts 111 spaced from each other and a crossbar 112 located between and connecting the upright posts 111. The pivoting mechanism 12 includes a base 121 mounted on a rotation center of the stands 110, a pivot bracket 122 mounted on the bottom of the table plate 13, and a shaft 123 extending through the base 121 and the pivot bracket 122 to pivotally connect the base 121 and the pivot bracket 122. When the support device 1 is disposed at an expanded position as shown in FIG. 1, the upper end of each of the upright posts 111 of the stands 110 supports the bottom of the table plate 13. When the support device 1 is to be switched from the expanded position to a folded position as shown in FIG. 2, one of the stands 110 is rotated so that the upright posts 111 of the stands 110 are moved to abut each other. Then, the table plate 13 is driven, and the pivot bracket 122 is rotated about the shaft 123. When the support device 1 is switched to the folded position, the table plate 13 is disposed at an upright position and located at a side of the stand unit 11. Thus, the support device 1 can be folded to have a reduced volume. However, the table plate 13 cannot be folded so that the volume of the support device 1 cannot be reduced to the minimum.

BRIEF SUMMARY OF THE INVENTION

In accordance with the present invention, there is provided a support device comprising a bearing unit, and a supporting frame. The bearing unit includes two bearing members. Each of the bearing members has an abutting side. The supporting frame includes a supporting mechanism combined with the bearing members of the bearing unit, and a stand unit connected with the supporting mechanism and supporting a bottom of the bearing unit. The supporting mechanism includes a mounting bracket mounted on the bottom of the bearing unit. The mounting bracket includes two connecting plates each mounted on a bottom of one of the bearing members, and a supporting plate disposed between the connecting plates and pivotally connected with the connecting plates. When the support device is disposed at an expanded position, the abutting sides of the bearing members are parallel and juxtaposed to each other, and the supporting plate of the supporting mechanism bridges and supports the bottom of the abutting sides of the bearing members. When the support device is switched to a collapsed position, the bearing members are arranged in an upright manner and are located at two opposite side of the supporting frame.

According to the primary advantage of the present invention, the support device has a largely reduced volume and has an enhanced strength to withstand a larger force or weight.

According to another advantage of the present invention, when the support device is switched to the collapsed position, the supporting frame is folded, and the bearing members are located at two opposite side of the supporting frame, so that the volume of the support device is reduced largely. According to a further advantage of the present invention, the supporting frame enhances the structural strength of the bearing unit so that the support device can withstand a larger force or weight.

According to a further advantage of the present invention, the support device is available for a table, a chair, a shelf, a podium and the like, thereby enhancing the versatility of the support device.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
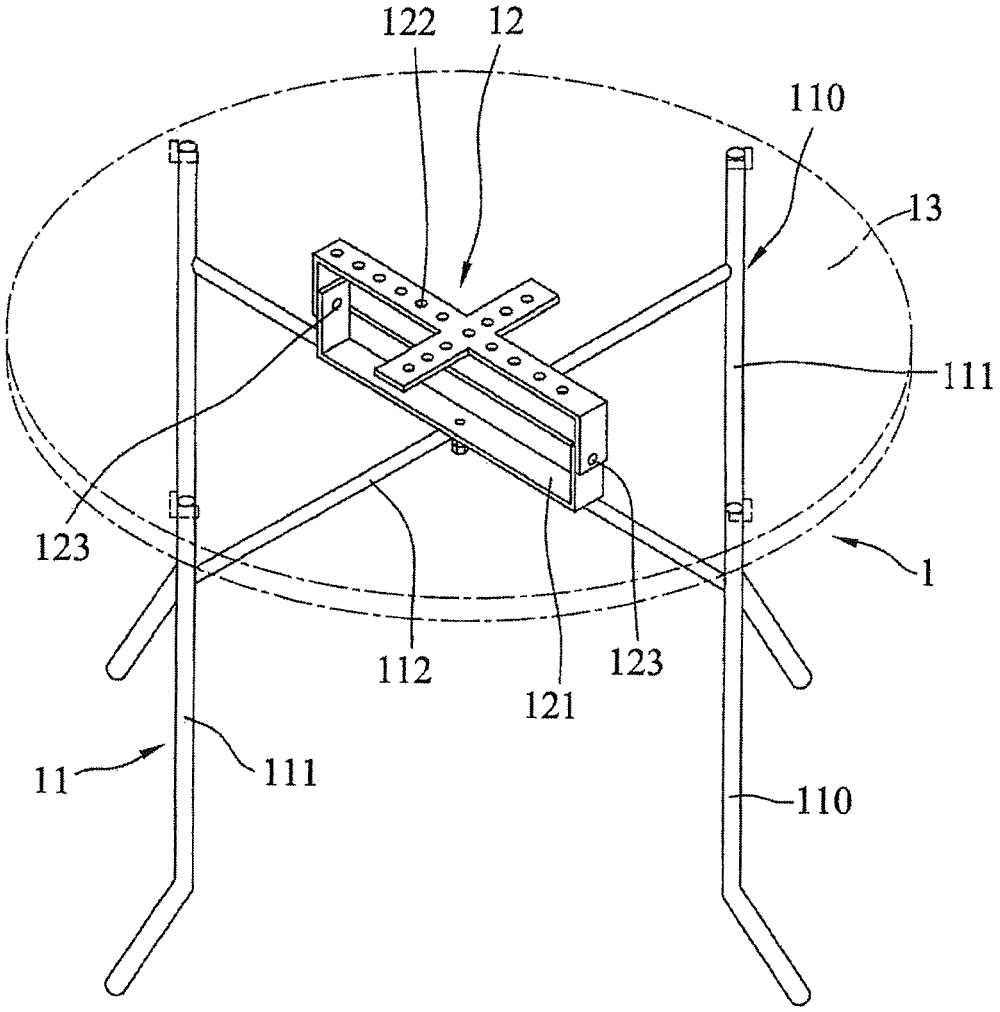
FIG. 1 PRIOR ART
FIG. 1 is a perspective view of a conventional support device in accordance with the prior art.
Figure 2:
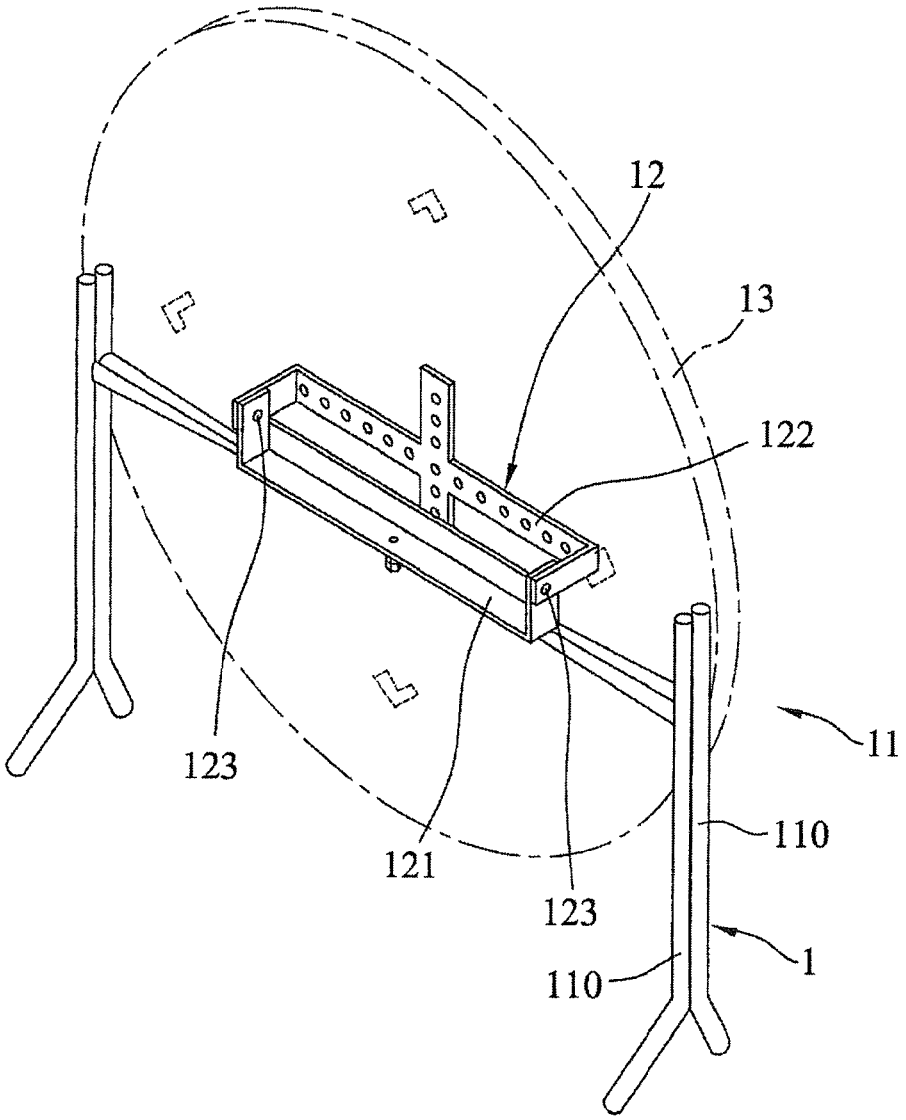
FIG. 2 PRIOR ART
FIG. 2 is a folded view of the conventional support device as shown in FIG. 1.
Figure 3:
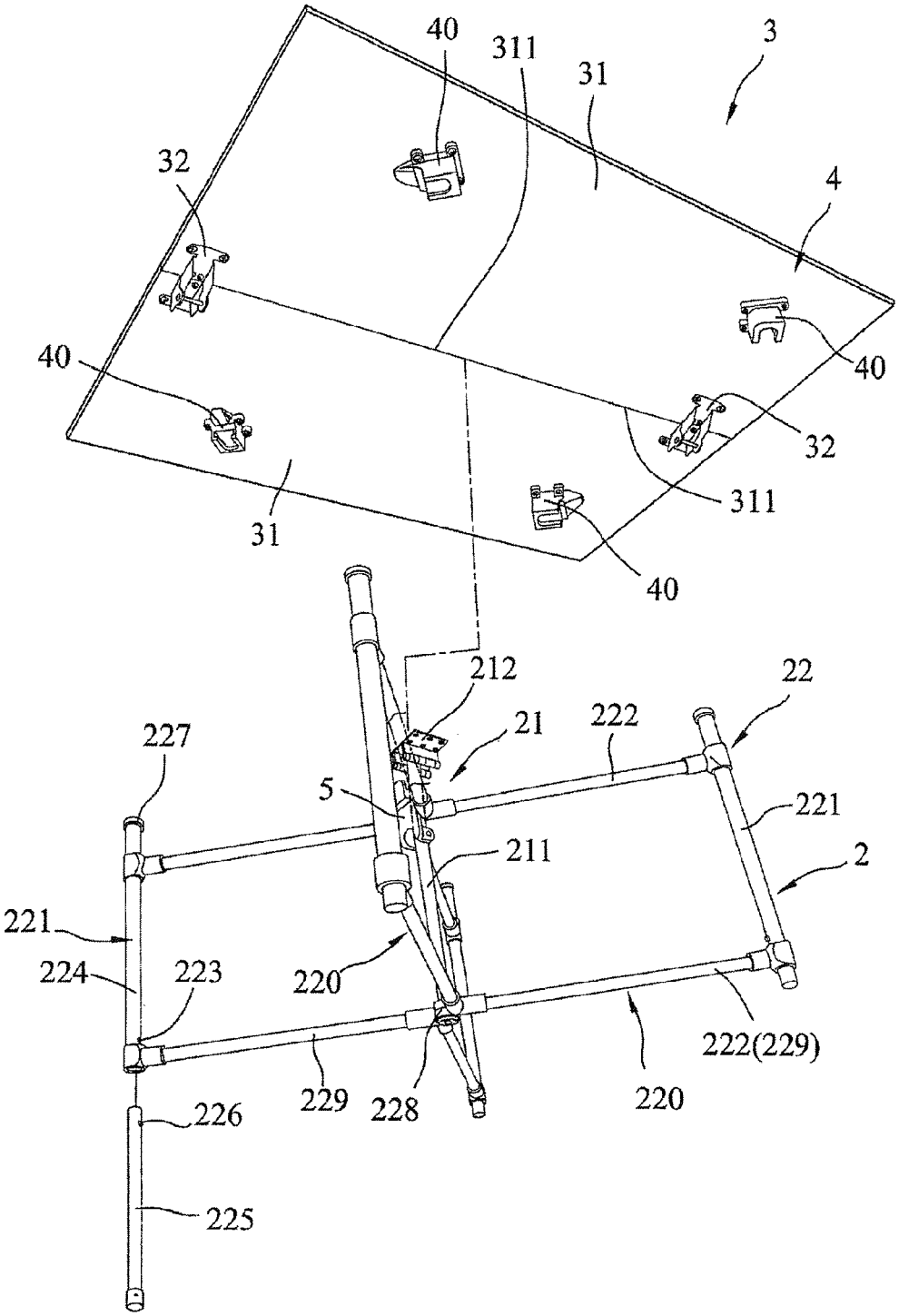
FIG. 3 is a partially bottom exploded perspective view of a support device in accordance with the preferred embodiment of the present invention.
Figure 4:
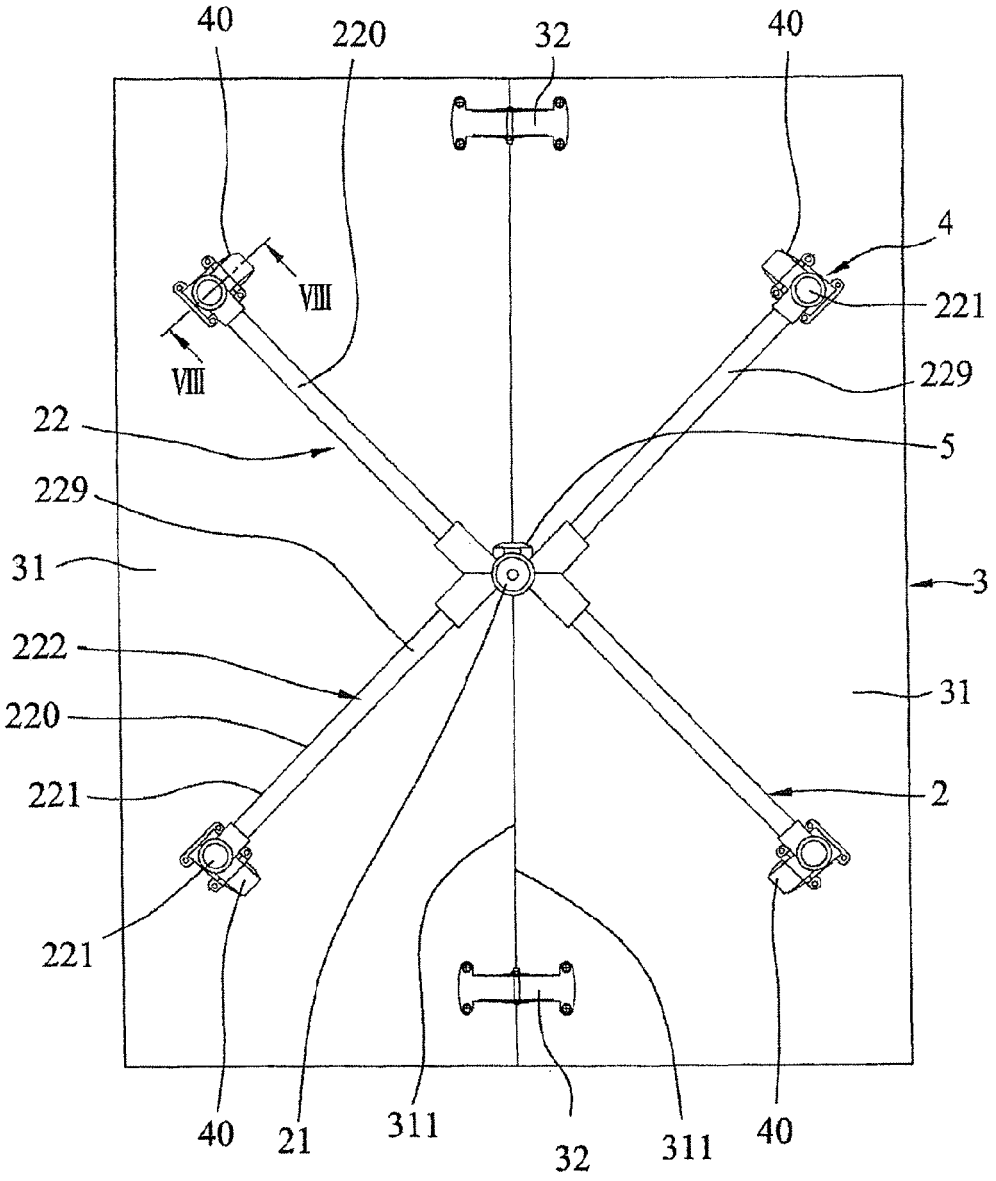
FIG. 4 is a bottom cross-sectional assembly view of the support device as shown in FIG. 3.
Figure 5:
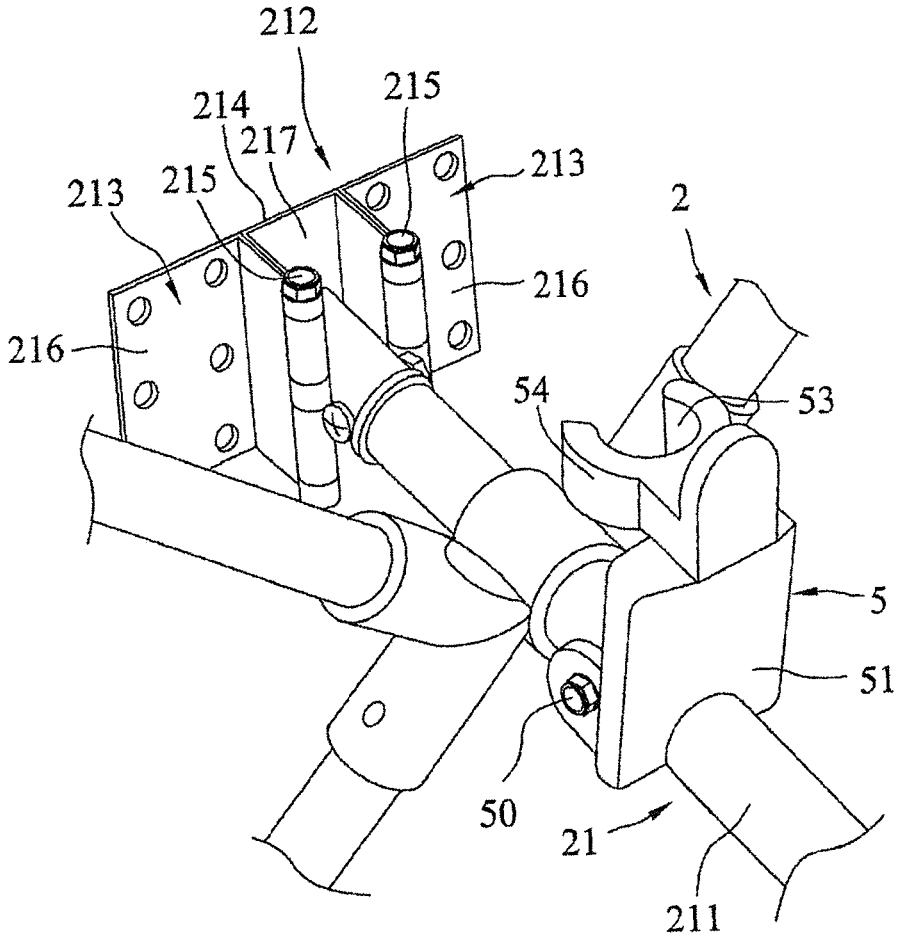
FIG. 5 is a locally enlarged view of the support device as shown in FIG. 3.

Referring to the drawings and initially to FIGS. 3-5, a support device in accordance with the preferred embodiment of the present invention comprises a bearing unit 3, a supporting frame 2 for lifting the bearing unit 3, a positioning mechanism 4 mounted on a bottom of the bearing unit 3 and connected with the supporting frame 2 to expand the supporting frame 2 solidly and stably, and a locking unit 5 mounted on the supporting frame 2 to prevent the supporting frame 2 from being folded improperly. When in use, the support device is switched between an expanded position and a collapsed position. In the preferred embodiment of the present invention, the support device is available for a table, a chair, a shelf, a podium and the like, to support an object or a human body.

Figure 11:
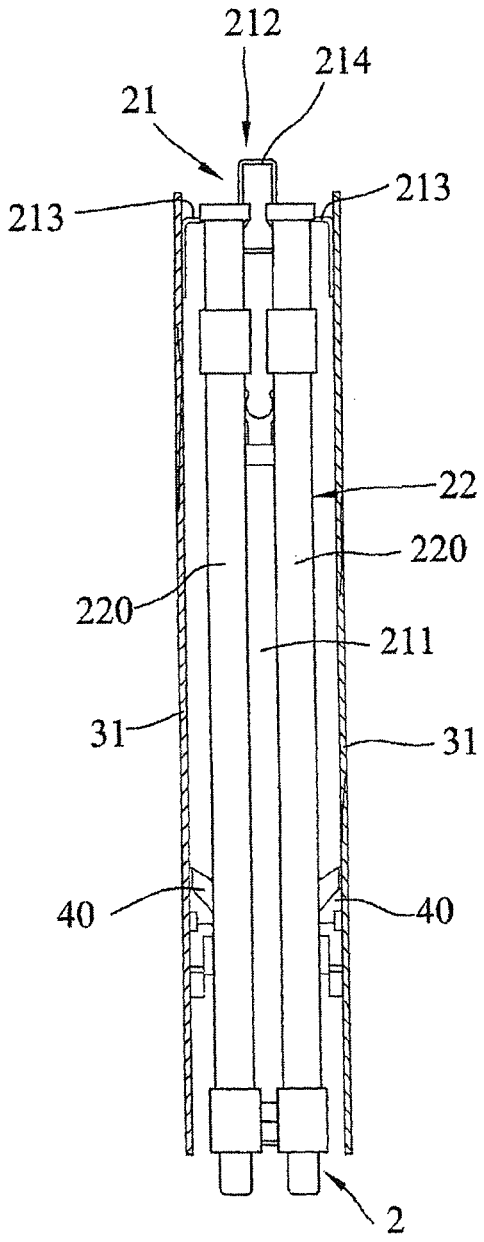
FIG. 11 is a folded view of the support device as shown in FIG. 7.

The bearing unit 3 includes two bearing members 31, and two hinge members 32 each bridging and pivotally connected with the bearing members 31. The bearing members 31 are disposed between a first position as shown in FIG. 3 where the bearing members 31 are juxtaposed horizontally to each other and a second position as shown in FIG. 11 where the bearing members 31 are arranged in an upright manner and are in parallel with each other. Each of the bearing members 31 has an abutting side 311, and the abutting sides 311 of the bearing members 31 are adjacent to each other. In the preferred embodiment of the present invention, each of the bearing members 31 is a plate or board.

The supporting frame 2 is located under the bearing unit 3 and includes a supporting mechanism 21 mounted on the bottom of the bearing unit 3 and located at a geometric center of the bearing unit 3, and a stand unit 22 pivotally connected with the supporting mechanism 21. The supporting mechanism 21 bridges the bearing members 31 and is located between and in line with the hinge members 32. The supporting mechanism 21 includes an upright central post 211, and a mounting bracket 212 mounted on an upper end of the central post 211. Preferably, the central post 211 and the mounting bracket 212 are combined securely by fixing members, such as screws, rivets or the like. Alternatively, the central post 211 and the mounting bracket 212 are combined securely by soldering or rivet pressing. The mounting bracket 212 includes two substantially L-shaped connecting plates 213 each mounted on a bottom of one of the bearing members 31 by a plurality fixing members, and a substantially U-shaped supporting plate 214 disposed between the connecting plates 213. Each of the connecting plates 213 is pivotally connected with the supporting plate 214 by a first pivot shaft 215 and has an abutting wall 216. The supporting plate 214 has an abutting wall 217. Thus, when the support device is disposed at the expanded position, the abutting wall 216 of each of the connecting plates 213 is juxtaposed to and in line with the abutting wall 217 of the supporting plate 214.

The stand unit 22 includes two stands 220. Each of the stands 220 includes two upright modules 221 each supporting the bottom of each of the bearing members 31 when the support device is disposed at the expanded position, and at least one transverse module 222 connected with the upright modules 221 and pivotally connected with the central post 211. In the preferred embodiment of the present invention, each of the stands 220 includes two spaced transverse modules 222 each of which is connected with the upright modules 221 and pivotally connected with the central post 211. Each of the upright modules 221 of each of the stands 220 includes an upright outer sleeve 224 having a positioning hole 223, an inner sleeve 225 retractably mounted in the outer sleeve 224, and a positioning member 226 mounted on the inner sleeve 225 and releasably locked in the positioning hole 223 of the outer sleeve 224. Each of the upright modules 221 of each of the stands 220 of the supporting frame 2 has an upper end provided with a locking protrusion 227. Preferably, the locking protrusion 227 of each of the upright modules 221 of each of the stands 220 is formed on the outer sleeve 224. The transverse module 222 of each of the stands 220 includes a rotation sleeve 228 pivotally mounted on the central post 211, and two extensions 229 each connected between the rotation sleeve 228 and the outer sleeve 224 of one of the upright modules 221.

Figure 6:
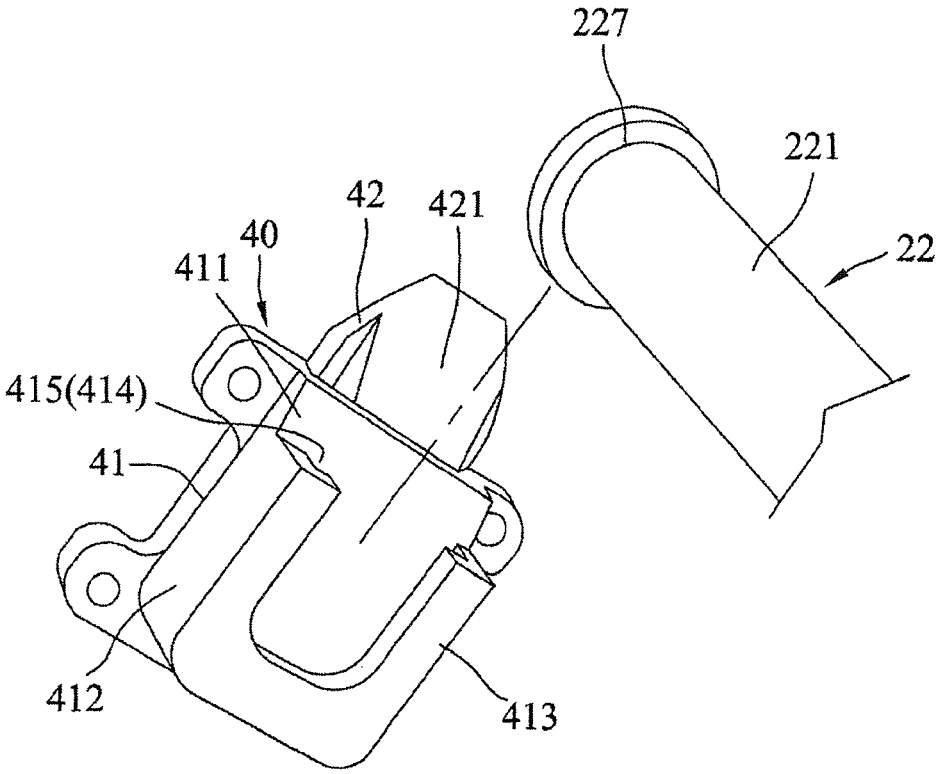
FIG. 6 is a locally enlarged view of the support device as shown in FIG. 3.

Referring to FIGS. 4-6, the positioning mechanism 4 includes a plurality of positioning seats 40 respectively mounted on the bottom of each of the bearing members 31. In the preferred embodiment of the present invention, the positioning mechanism 4 includes four positioning seats 40. Each of the positioning seats 40 includes a main body 41 provided with a positioning recess 414, and a guide portion 42 integrally connected with the main body 41. The main body 41 of each of the positioning seats 40 has a base wall 411 mounted on the bottom of one of the bearing members 31, a substantially U-shaped sidewall 412 protruding downward and vertically from the base wall 411, and a bottom wall 413 extending horizontally from a bottom of the sidewall 412. The sidewall 412 and the bottom wall 413 of the main body 41 of each of the positioning seats 40 are combined to form the positioning recess 414. The positioning recess 414 of the main body 41 of each of the positioning seats 40 has an opening 415 directed toward the guide portion 42 and has height and width corresponding to that of the locking protrusion 227 of one of the stands 220. The guide portion 42 of each of the positioning seats 40 has a proximate end located adjacent to the positioning recess 414 and a distal end spaced away from the positioning recess 414. The guide portion 42 of each of the positioning seats 40 has a guiding ramp 421 which is directed downward and is gradually tapered from the proximate end toward the distal end of the guide portion 42.

The locking unit 5 is mounted on the supporting mechanism 21 to prevent the stands 220 from being pivoted. The locking unit 5 is pivotally mounted on the central post 211 and includes a stop piece 51 located between the transverse modules 222 of the stands 220, and a clamping wall 54 connected with the stop piece 51 and defining a locking recess 53 snapped onto the central post 211. The locking recess 53 has an inner diameter corresponding to a diameter of the central post 211. In the preferred embodiment of the present invention, the locking unit 5 is pivotally connected with the central post 211 of the supporting frame 2 by a second pivot shaft 50.

Figure 7:
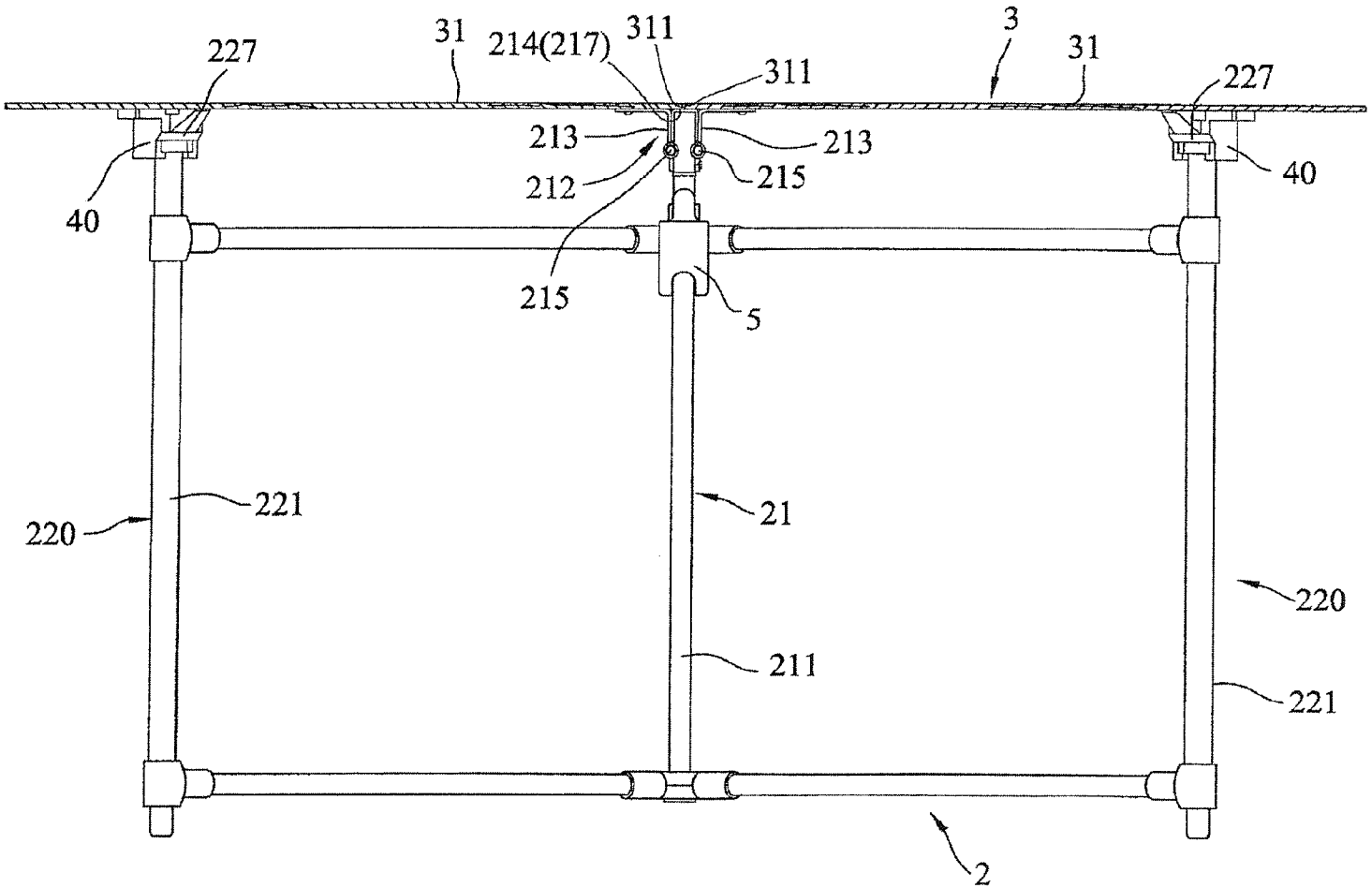
FIG. 7 is a cross-sectional assembly view of the support device as shown in FIG. 3.
Figure 8:
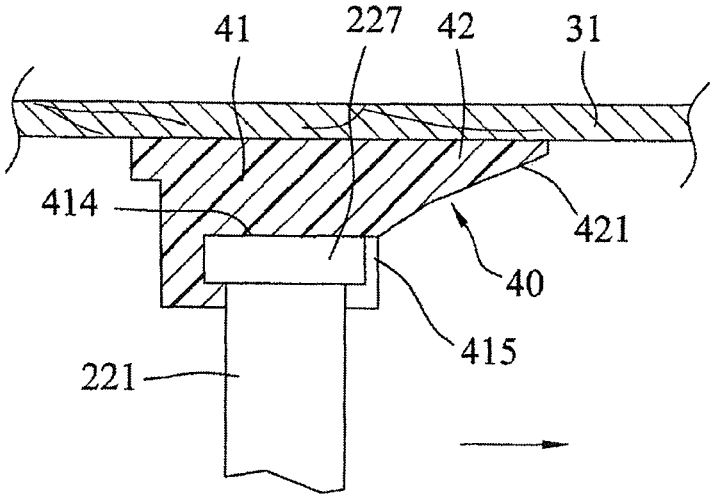
FIG. 8 is a cross-sectional view of the support device taken along line VIII-VIII as shown in FIG. 4.
Figure 9:
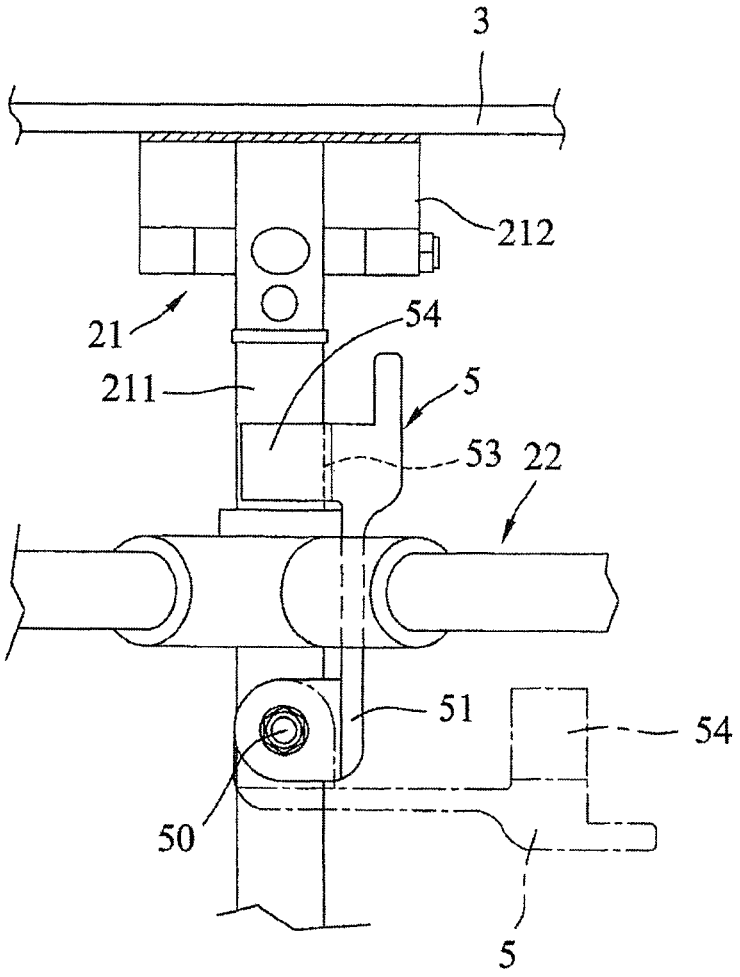
FIG. 9 is a schematic cross-sectional operational view showing connection of a locking unit and a supporting mechanism of the support device.

Referring to FIGS. 4 and 7-9, when the support device is disposed at the expanded position as shown in FIG. 7, the locking protrusion 227 of each of the upright modules 221 of each of the stands 220 is guided along the guiding ramp 421 of one of the positioning seats 40 into the positioning recess 414, and each of the connecting plates 213 of the mounting bracket 212 of the supporting mechanism 21 is mounted on the bottom of one of the bearing members 31. At this time, the abutting wall 217 of the supporting plate 214 of the supporting mechanism 21 bridges the abutting sides 311 of the bearing members 31, and co-operates with the hinge members 32 of the bearing unit 3 to support the bearing members 31. Thus, when the support device is disposed at the expanded position, the bearing members 31 are supported solidly and stably by the supporting mechanism 21 and the upright modules 221 of each of the stands 220. Then, the locking unit 5 is pivoted about the second pivot shaft 50 and is moved upward so that the locking recess 53 of the locking unit 5 is snapped onto the central post 211, and the stop piece 51 of the locking unit 5 is located between the extensions 229 of the transverse modules 222 of the stands 220, to prevent the stands 220 from being pivoted freely. In the preferred embodiment of the present invention, the inner sleeve 225 is retractably mounted in the outer sleeve 224 to adjust the length of each of the upright modules 221 of each of the stands 220 as shown in FIG. 3.

Figure 10:
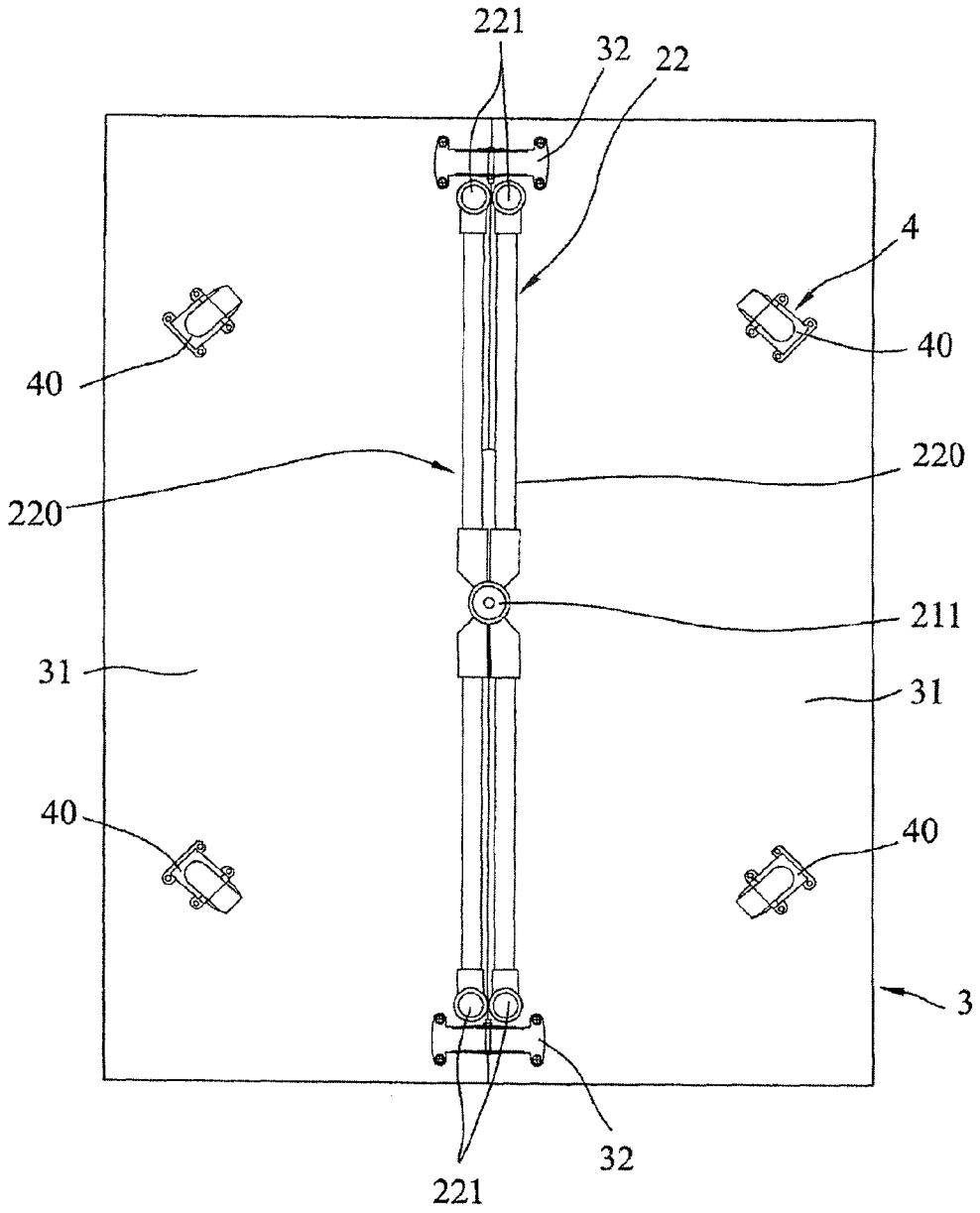
FIG. 10 is a folded view of the support device as shown in FIG. 4.

Referring to FIGS. 8-11, when the support device is to be switched from the expanded position to the collapsed position as shown in FIG. 11, the locking unit 5 is pivoted about the second pivot shaft 50 and is moved downward so that the locking recess 53 of the locking unit 5 is detached from the central post 211, and the stop piece 51 of the locking unit 5 is separated from the extensions 229 of the transverse modules 222 of the stands 220. Thus, the supporting frame 2 is unlocked from the locking unit 5 so that the stands 220 can be pivoted freely. Then, the stands 220 are rotated about the central post 211, so that the locking protrusion 227 of each of the upright modules 221 of each of the stands 220 is detached from the positioning recess 414 of each of the positioning seats 40. In such a manner, the stands 220 are pivoted toward each other and are moved from the expanded position as shown in FIG. 4 to the collapsed position as shown in FIG. 10, so that the supporting frame 2 is folded. After the stands 220 of the supporting frame 2 are collapsed, the bearing members 31 are pivoted and moved downward by action of gravity and are located at two opposite side of the supporting frame 2 as shown in FIG. 11, so that the support device is switched to the collapsed position.

Figure 12:
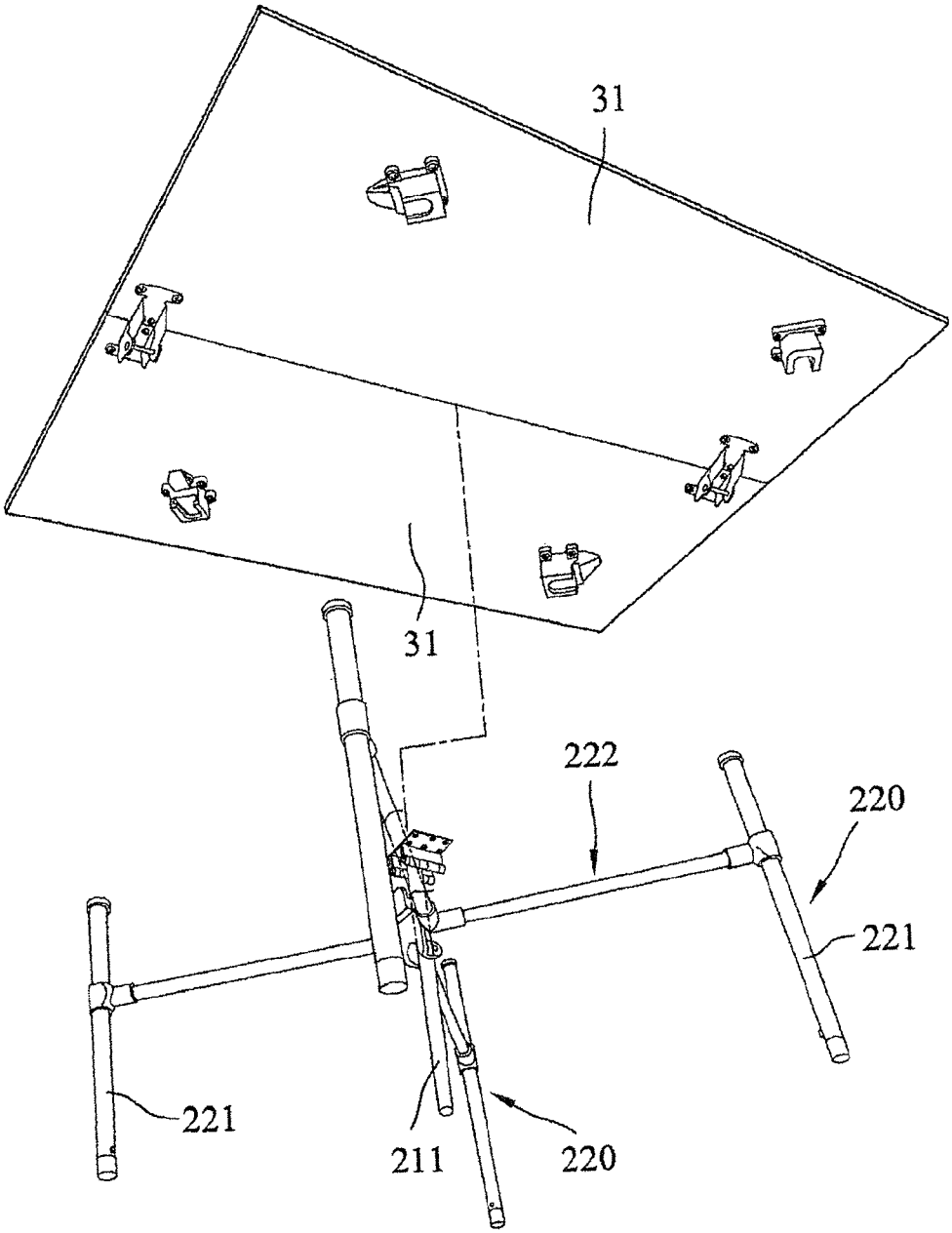
FIG. 12 is a partially bottom exploded perspective view of a support device in accordance with another preferred embodiment of the present invention.

Referring to FIG. 12, each of the stands 220 includes a transverse module 222 located between and connecting the upright modules 221 and pivotally connected with the central post 211.

In conclusion, the supporting plate 214 of the supporting mechanism 21 bridges the abutting sides 311 of the bearing members 31, and co-operates with the hinge members 32 of the bearing unit 3 to support the bearing members 31, so that when the support device is disposed at the expanded position, the bearing members 31 are supported solidly and stably by the supporting mechanism 21 and the upright modules 221 of each of the stands 220.

Accordingly, when the support device is switched to the collapsed position, the supporting frame 2 is folded, and the bearing members 31 are located at two opposite side of the supporting frame 2, so that the volume of the support device is reduced largely. In addition, the supporting frame 2 enhances the structural strength of the bearing unit 3 so that the support device can withstand a larger force or weight. Further, the support device is available for a table, a chair, a shelf, a podium and the like, thereby enhancing the versatility of the support device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A support device comprising:

a bearing unit and a supporting frame, wherein:

the bearing unit includes two bearing members;

each of the two bearing members has an abutting side;

the supporting frame includes:

a supporting mechanism combined with the two bearing members of the bearing unit; and a stand unit connected with the supporting mechanism and supporting a bottom of the bearing unit;

the supporting mechanism includes a mounting bracket mounted on the bottom of the bearing unit;

the mounting bracket includes:

two connecting plates each mounted on a bottom of one of the two bearing members; and a supporting plate disposed between the connecting plates and pivotally connected with the two connecting plates;

when the support device is disposed at an expanded position, the abutting sides of the two bearing members are parallel and juxtaposed to each other, and the supporting plate of the supporting mechanism bridges and supports the bottom of the abutting sides of the two bearing members;

when the support device is switched to a collapsed position, the two bearing members are arranged in an upright manner and are located at two opposite side of the supporting frame the supporting mechanism includes an upright central post having an upper end combined with the mounting bracket;

the stand unit includes two stands each pivotally connected with the upright central post of the supporting mechanism;

each of the two stands includes:

two upright modules each supporting the bottom of each of the two bearing members when the support device is disposed at the expanded position; and at least one transverse module connected with the two upright modules and pivotally connected with the upright central post;

each of the two upright modules of each of the two stands includes:

an upright outer sleeve;

an inner sleeve retractably mounted in the upright outer sleeve; and a positioning member mounted on the inner sleeve and locked onto the upright outer sleeve to position a connecting length of the inner sleeve and the upright outer sleeve;

the at least one transverse module of each of the two stands includes:

a rotation sleeve pivotally mounted on the upright central post; and two extensions each connected between the rotation sleeve and one of the two upright modules;

the bearing unit further includes two hinge members each pivotally connected with the two bearing members; and the supporting mechanism is located between and in line with the two hinge members.

2. The support device of claim 1, wherein:

the support device further comprises a positioning mechanism including a plurality of positioning seats respectively mounted on the bottom of each of the two bearing members;

each of the plurality of positioning seats includes:

a main body provided with a positioning recess for locking one of the two upright modules; and a guide portion connected with the main body; and each of the two upright modules of each of the two stands of the supporting frame has an upper end provided with a locking protrusion that is guided by the guide portion of one of the plurality of positioning seats into the positioning recess.

3. A support device of claim 1, wherein:

the support device further comprises a locking unit mounted on the supporting mechanism to prevent the two stands from being pivoted; and the locking unit is pivotally mounted on the upright central post and includes:

a stop piece located between the at least one transverse modules of the two stands; and a clamping wall connected with the stop piece and defining a locking recess snapped onto the upright central post.

* * * * *